United States Patent [19]

Scheithauer, Jr. et al.

[11] 4,070,184

[45] Jan. 24, 1978

[54] PROCESS FOR PRODUCING REFRACTORY CARBIDE GRADE POWDER

[75] Inventors: William Scheithauer, Jr., Athens; Joseph E. Ritsko, Towanda, both of Pa.

[73] Assignee: GTE Sylvania Incorporated, Stamford, Conn.

[21] Appl. No.: 726,305

[22] Filed: Sept. 24, 1976

[51] Int. Cl.[2] ..... B22F 3/00; C22C 29/00

[52] U.S. Cl. ..... 75/203; 75/204; 75/211; 75/.5 R; 75/.5 B

[58] Field of Search ..... 75/.5 R, .5 B, 203, 75/204, 211

[56] References Cited

U.S. PATENT DOCUMENTS

| | | | |
|---|---|---|---|
| 3,525,610 | 8/1970 | Meadows et al. | 75/204 |
| 3,698,891 | 10/1972 | Patil et al. | 75/211 |
| 3,713,816 | 1/1973 | MacCragh et al. | 75/211 |
| 3,846,126 | 11/1974 | Foley et al. | 75/211 |
| 3,865,586 | 2/1975 | Volin et al. | 75/204 |
| 3,929,476 | 12/1975 | Kirby, Jr. et al. | 75/211 |

*Primary Examiner*—Brooks H. Hunt

*Attorney, Agent, or Firm*—Norman J. O'Malley; Donald R. Castle; John C. Fox

[57] ABSTRACT

A process for producing a refractory carbide grade powder having improved particle size distribution and pressing characteristics. The process comprises forming an aqueous slurry of a standard refractory metal carbide powder and the desired matrix, attritor milling for 1 to 10 hours, removing the milled slurry from the mill, forming an aqueous slurry having a desired solid concentration, adding a water-soluble relatively long chain polyglycol as a pressing aid and spray drying the slurry to form spherical particles suitable for pressing and sintering. During sintering less grain growth of the refractory metal carbide grade powders occurs than with conventional grade powders sintered under essentially the same temperature conditions.

5 Claims, No Drawings

PROCESS FOR PRODUCING REFRACTORY CARBIDE GRADE POWDER

BACKGROUND OF THE INVENTION

1. Field of the Invention

This invention relates to refractory metal carbide grade powders. Such powders contain a refractory metal carbide, a matrix metal and a pressing aid.

It also relates to a process for producing cemented carbides from such grade powders.

2. Prior Art

Grade powders are defined herein as an intimate mixture of refractory metal carbides powder plus a metallic cementing phase or matrix. Generally the grade powders include a binder which also serves as a pressing lubricant. The most common example of a grade powder is a mixture of tungsten carbide, cobalt, and paraffin wax. The carbide powder can consist of other carbides or mixtures thereof and are generally the refractory carbides as used herein include carbides of metals from the groups IV, V, and VI metals that have a melting point above about 1895° C. Cobalt is the most common matrix, at least for WC, but, nickel, iron, and molybdenum either singly, in combination, or in combination with cobalt are sometimes used particularly when refractory metals other than tungsten are used. For example, the matrix phase for TiC is either nickel or a nickel-molybdenum alloy, thus as used herein the matrix metal is selected from the iron group of metals and alloys of the iron group of metals.

The most common practice for producing carbide grade powders involves a sequence of operations consisting of ball milling, drying and granulation. While this seems relatively straightforward, there are many intermediate processes and handling steps that complicate the operation. Typically, as an example, powders of WC and cobalt are weighed in the appropriate proportions and charged into a ball mill. To prevent oxidation of the powders, milling is always done in the presence of a milling fluid. Organic fluids such as hexane, heptane, primary alcohol, acetone, and the like are used. Depending on the particular grade of powder and desired powder characteristics milling times are from many hours to several days. After milling the fluid must be removed such that a dried powder is obtained. Drying generally involves some type of distillation process so that the fluid can be recovered and reused. A typical process would be to discharge the slurry into another vessel and then with the combination of heat and vacuum remove the fluid.

More recently, a process involving close-cycle spray drying has been used to remove and recover the milling fluid.

If the spray drying process is not used, several additional steps are required after conventional drying of the powders. Typically a wax, and most commonly paraffin wax, is added to the ball mill. If wax is not added to the mill, it must be incorporated into the dried powder. This step is called waxing and is done in a variety of ways.

The dried grade powders containing wax are generally fine and fluffy and have very poor flow characteristics. It is important that the powders have good flow to facililtate transfer from a powder hopper to the die cavity during pressing. Therefore, these fine, fluffy powders are converted by an operation called granulation to a flowable powder. One common method is to press the fine powders at low pressures into a loose compact or slug. This slug is then forced through a screen. The screened product is in the form of small, irregular shaped granules which will conveniently flow into compacting dies in a more controlled manner. If the spray drying process is used a free flowing powder is obtained directly as this is one of the purposes of spray drying. That is, in addition to drying a free flowing spherical powder is obtained.

Over the years, the following process has evolved as the most used method for preparing carbide grade powders. It involves the following steps, ball milling with alcohol or acetone, tungsten carbide, cobalt and paraffin wax and drying in a close-cycle spray dry system.

While this process is a considerable improvement from the previous practice it still has disadvantages compred to the process that will be described in this invention. Some of the disadvantages are the lengthy ball milling cycle. If this type of milling is used, a flammable solvent, the use of paraffin wax and an expensive drying system.

Additionally, the products produced from ball milling contain a relatively high level of sub-micron refractory metal carbide particles. During the subsequent sintering process, the fine particles preferentially and quickly dissolve in the binder and upon cooling become deposited upon the surfaces of the undissolved carbide. This procedure is known as grain growth and lowers the strength of the subsequently produced cemented carbide articles. Various techniques for reducing the amount and level of grain growth have been developed. The most commonly used technique for reducing grain growth is to use an additive which interferes with the grain growth mechanism. Another method not now widely used is a hot pressing technique. The hot pressing technique is described in U.S. Pat. No. 3,451,791.

Attritor milling has been used recently for particle size reduction in place of ball milling because a given particle size reduction can be achieved in a shorter period of time than ball milling. In the production of grade powders of the subsequent production of cemented refractory metal carbides the purpose of ball milling is not to reduce the size of particles but rather to uniformly distribute the binder phase throughout the larger amount of the carbide phase.

The organic fluids previously used as milling aids, such as hexane, heptane, the primary alcohols, acetone and the like, are all flammable materials thus extreme safety precautions must be taken to prevent air leakage into the system used to remove the milling aid. The vapors from these milling aids also are toxic to the worker. Hence, additionally precautions in handling are required.

It is believed, therefore, a process that can be conducted in an open system without fire and health hazards and produces a carbide grade powder having improved properties and characteristics would be an advancement in the art. It is also believed that a carbide grade powder that exhibits a marked decrease in grain growth during sintering when processed by normal sintering techniques and does not contain a grain growth inhibitor is an advancement in the art.

OBJECTS AND SUMMARY OF THE INVENTION

It is an object of this invention to provide an improved refractory metal carbide grade powder.

It is a further object of this invention to provide an improved process for producing carbide grade powders.

It is another object of this invention to provide an improved process for producing cemented refractory metal carbides.

These and other objects are achieved in one aspect of this invention by a process comprising forming an aqueous slurry of water and solids consisting essentially of a refractory metal carbide and a suitable matrix metal or metal alloy in the desired ratio, the water and solids being in the weight ratio of from about 1:2 to about 1:4, attritor milling said slurry for from about 1 to about 10 hours, removing the slurry from the milling and forming a solid concentration of from about 70 to about 90% by weight, adding from about 1 to about 3% by weight, based upon the solids, of a water-soluble relatively long chain polyglycol to the slurry and spray drying the resulting slurry at a temperature sufficient to remove the water to from an improved powder consisting essentially of the refractory metal carbide, the binder and the polyglycol. The powder contains spherical particles having a relatively narrow size distribution and is capable of being pressed into shapes having an improved green strength and upon sintering the relative amount of grain growth is reduced.

DETAILED DESCRIPTION OF THE PREFERRED EMBODIMENT

For a better understanding of the present invention, together with other and further objects, advantages and capabilities thereof, reference is made to the following disclosure and appended claims in connection with the above-description of some of the aspects of the invention.

The present invention is an improvement over the most modern practice used today for preparing carbide grade powders. It involves three basic and radical departures from the common practice.

1. The use of water as a milling fluid as opposed to flammable organics.
2. The use of an open-cycle spray-drying system as opposed to closed system.
3. The use of water soluble, long-chain polyvinyl alcohol as a mixing aid instead of paraffin wax. The basic advantages of the process of this invention are cost, safety, flexibility of operation, and product improvement.

The use of a long chain polyglycol as compared to standard paraffin is an important feature of this invention. After pressing these powders, much higher green strengths can be obtained than was possible with a paraffin wax system. The higher green strength has many ramifications which are important in the pressing of powders and handling of pressed compacts. One of the problems encountered in the pressing of grade powders is cracking upon release from the die. This cracking seems to be a direct function of the inherent strength of the compact after it is pressed. If conventional powders containing paraffin are pressed much above 25,000 psi, chances are high the cracking will occur. When the powders, spray dried into the open-cycle system with a long chain polyglycol, such as Carbowax 6000, are pressed at pressures up to 40,000 psi with no cracking occurring. This obviously allows much more flexibility in the pressing operation and more flexibility in controlling shrinkage.

Each step in this new process will be compared to the more conventional process to illustrate the differences and advantages of the new process.

As discussed, grade powders are typically prepared by ball milling. More recently attritor milling has been used. Attritor milling is used in this process because it is the quickest and most economical method for making the grade powder slurry. In common practice when using attritor milling an organic solvent is used as the milling fluid. In our process water is used as the milling fluid for its obvious advantages as far as cost and safety.

The attritor mill is commercially available from Union Process Corporation in this country and by foreign companies licensed by Union Process. Patents on the attritor have been issued to Dr. Andrew Szegvari, U.S. Patents: Nos. 2,764,359; U.S. Pat. No. 3,450,356; U.S. Pat. No. 3,149,789; U.S. Pat. No. 3,008,657; and U.S. Pat. No. 3,131,875.

Paraffin wax is the binder system that is most commonly used in all grades of carbide. As discussed, it is either incorporated in the ball mill or added to the grade powders by some method after the milled slurry has been dried. In the present invention, Carbowax 6000, a product typically known as a polyglycol and distributed by Union Carbide Corporation, is used. It is water soluble and has a relatively long chain length. It is added to the slurry after it has been discharged from the attritor mill.

The use of organic solvents as mentioned, and their flammability requires the use of a close-cycle spray drying system. This system, as inferred from its name, is closed loop and utilizes a nitrogen atmosphere. While this system works well, its two inherent drawbacks are high initial cost, because of the equipment necessary to recover the organic solvent. It is a large system and more easily operated with large lots of powder. This somewhat reduces its flexibility. Because water is used as a milling fluid, the expensive close-cycle system is not necessary but rather the relatively inexpensive open-cycle system which used air as the drying atmosphere. This type of equipment is one-fourth to one-third the cost of the close-cycle system. In addition, it has much greater flexibility in that the small lots can easily be dried. Lots as small as 15 kg can be dried. The close-cycle system generally requires a minimum lot size of 100 kg.

While the invention has been described in terms of using the refractory metal carbide grade powder to produce cemented carbides, the powder produced hereby can also have other usages such as in hard facing application e.g., plasma spray coating, mixing with brazing alloys and the like.

Normally the amount of matrix metal will be from about 2 to about 25% by weight of the refractory metal carbide and matrix metal composition and from about 5 to about 20% by weight is preferred.

The average particle size of the refractory metal carbide is generally from slightly less than 1 micron to about 25 micrometers. The most common tungsten carbide generally is between 1 to 2 micrometers. As previously mentioned, grain growth inhibitors can be employed to prevent grain growth. Materials commonly used are molybdenum carbide, vanadium carbide, and chromium carbide. If used they are incorporated into the first aqueous slurry, that is, prior to attritor milling, or can be subsequently added to the grade powder. Preferrably they are added prior to attritor milling to insure more uniform distribution.

To more fully illustrate the subject invention, the following examples are presented. All parts, proportions, and percentages are by weight unless otherwise indicated.

EXAMPLE I

The following charge is added to an attritor mill that contains WC-13 Co balls:

WC Powder — 5,460 parts

Co Powder — 540 parts $H_2O$ — 2,000 parts

The mill is adjusted so that the agitator shaft turns at 200 rpm. Milling time can vary from 1 to 10 hours. For this particular grade which contains 9% cobalt, and a medium particle size WC, 1 hour is sufficient time. Milling times have to be increased as cobalt content is decreased and more importantly when finer WC powders are used.

After the appropriate milling time is reached, the slurry is discharged from the mill. This generally requires the addition of some $H_2O$ to thin the slurry and rinse the mill. During discharging the slurry is passed through a 400 mesh screen. This allows for the removal of contamination that may have been introduced and any chips from the milling balls.

Water is decanted from the screened slurry to obtain the desired solids concentration for spray drying. Generally, this ranges from 70–90%, and for this example of WC-9% Co a solids concentration of 80% is used.

Next the slurry is transferred to the spray dryer feed tank. It is heated, to about 50° C, and agitated while the Carbowax 6000 addition is made. This addition is generally 1–3%. For this grade it is preferably 2%. At this point the spray drying process begins. A suitable spray drier is a Proctor - Schwartz spray tower with two-fluid top-nozzle atomization. Some of the important drying parameters are air pressure of 20 psi, an inlet drying temperature of 200°–230° C and an outlet temperature of 100°–130° C.

After drying the product is spherical and free flowing and ready for subsequent use. Some properties which distinguish it from conventional powders are listed below.

| | Spray Dried With Carbowax 6000 | Conventional Powders With Paraffin Wax |
|---|---|---|
| Hall Flow Rate sec/50g | 20.00 | 27.00 |
| Bulk Density, g/cc | 3.80 | 4.10 |
| Green Strength After Compacting at 20 ksi, psi | 1350.00 | 520.00 |

While there has been shown and described what are at present considered the preferred embodiments of the invention, it will be obvious to those skilled in the art that various changes and modifications may be made therein without departing from the scope of the invention as defined by the appended claims.

What is claimed is:

1. A process suitable for producing a refractory metal carbide grade powder, said process comprising:
   a. forming a first aqueous slurry consisting essentially of water and solids in a weight ratio of from about 1:2 to about 1:4, said solids consisting essentially of a refractory metal carbide and a metal selected from the iron group of metals and alloys of the iron group of metals,
   b. attritor milling said slurry for a period of time of from about 1 to about 10 hours,
   c. removing the slurry from the attritor mill and forming a second aqueous slurry having a solids concentration of from about 70% to about 90% by weight,
   d. adding from about 1 to about 3% by weight, based upon said solids of said slurry, of a water soluble, relatively long chain polyglycol to said slurry, and
   e. spray drying said second slurry at a temperature sufficient to remove said water to form a refractory metal carbide grade powder consisting essentially of said solids and said polyglycol.

2. A process according to claim 1 wherein said refractory metal carbide is tungsten carbide.

3. A process according to claim 2 wherein said matrix metal is cobalt.

4. A process according to claim 1 wherein said refractory metal carbide is titanium carbide and said matrix metal is either nickel or a nickel-molybdenum alloy.

5. A process according to claim 1 wherein said refractory metal carbide grade powder is subsequently pressed into a desired shape and said shape is sintered to form a cemented carbide article consisting essentially of said refractory metal carbide and said matrix metal.

* * * * *